US010760586B2

(12) United States Patent
Saccoccio et al.

(10) Patent No.: US 10,760,586 B2
(45) Date of Patent: Sep. 1, 2020

(54) POOL PUMP WITH MULTIPLE OUTLETS

(71) Applicant: Asia Connection LLC, New York, NY (US)

(72) Inventors: Mitch Saccoccio, Clarksville, VA (US); Jonathan Bonelli, New York, NY (US); Reza Afshar, Westlake Village, CA (US)

(73) Assignee: Asia Connection LLC, New York, NY (US)

( * ) Notice: Subject to any disclaimer, the term of this patent is extended or adjusted under 35 U.S.C. 154(b) by 0 days.

(21) Appl. No.: 16/368,109

(22) Filed: Mar. 28, 2019

(65) Prior Publication Data

US 2019/0219064 A1 Jul. 18, 2019

Related U.S. Application Data

(63) Continuation of application No. 15/617,493, filed on Jun. 8, 2017, now Pat. No. 10,323,651, which is a continuation of application No. 14/566,220, filed on Dec. 10, 2014, now Pat. No. 9,714,665.

(60) Provisional application No. 61/915,609, filed on Dec. 13, 2013.

(51) Int. Cl.
*F04D 29/42* (2006.01)
*F04D 29/70* (2006.01)

(52) U.S. Cl.
CPC ..... *F04D 29/426* (2013.01); *F04D 29/4293* (2013.01); *F04D 29/708* (2013.01); *F05D 2250/52* (2013.01)

(58) Field of Classification Search
CPC ..... F04D 1/04; F04D 13/02; F04D 29/42
See application file for complete search history.

(56) References Cited

U.S. PATENT DOCUMENTS

| | | | | |
|---|---|---|---|---|
| 3,790,300 | A * | 2/1974 | Gilliland | F04D 17/164 415/198.1 |
| 4,430,214 | A * | 2/1984 | Baker | E04H 4/1209 210/167.12 |
| 5,391,060 | A | 2/1995 | Kozumplik, Jr. et al. | |
| 5,622,481 | A | 4/1997 | Thut | |
| 5,984,644 | A | 11/1999 | Yu et al. | |
| 6,659,717 | B1 * | 12/2003 | Kao | F04D 29/708 415/121.2 |
| 7,037,085 | B1 | 5/2006 | Stark et al. | |
| 7,828,530 | B2 | 11/2010 | Queirel | |
| 7,874,400 | B2 * | 1/2011 | Teisseyre | F04D 29/669 181/200 |
| 8,713,724 | B1 * | 5/2014 | Goettl | E04H 4/1236 4/507 |
| 2011/0123357 | A1 * | 5/2011 | Leone | F04D 13/066 417/61 |
| 2014/0170000 | A1 * | 6/2014 | Paffrath | F04D 23/008 417/423.14 |
| 2014/0286747 | A1 * | 9/2014 | Fang | F04D 29/486 415/1 |

* cited by examiner

*Primary Examiner* — Woody A Lee, Jr.
(74) *Attorney, Agent, or Firm* — Dilworth & Barrese, LLP

(57) ABSTRACT

A liquid pump for use with a fluid circulation system for a body of water includes a strainer assembly; a centrifugal pump assembly having at least first and second outlet ports respectively oriented in vertical and horizontal directions; a motor; and, at least one cap configured and dimensioned to engage and close an outlet port.

13 Claims, 3 Drawing Sheets

POOL PUMP WITH MULTIPLE OUTLETS

REFERENCE TO PRIOR APPLICATION

This application claims the benefit of U.S. Provisional Application No. 61/915,609, filed Dec. 13, 2013, the entire contents of which are incorporated herein by reference.

BACKGROUND

The present invention relates to pumps and, more particularly, to centrifugal pumps for use in connection with fluid circulation systems for swimming pools, spas and other recreational bodies of water.

Numerous pumps have been developed in the past for use in connection with fluid circulation systems for swimming pools, spas, whirlpools and the like. A pump should adapt easily to the specific configuration of the existing fluid circulation system. For example, a return line of the fluid circulation system (which is typically connected to the pump, directly or indirectly) could be positioned either horizontally, vertically, or in any position therebetween; and, therefore, the outlet of the pump must be aligned with the return line accordingly.

However, many conventional pumps are not easily adaptable to a wide variety of configurations of fluid systems, and doing so typically involves substantial or total disassembly of the pumps. As a result, much time and labor are required to make the pumps adaptable.

Sometimes, a contractor who has been retained to install the pump must carry on hand two sets of pumps, one having a vertically positioned outlet and one having a horizontally positioned outlet, in order to ensure he or she has the correct pump that will adapt to the specific configuration of the fluid circulation system.

U.S. Pat. No. 7,531,092 discloses a pump having a casing with a single outlet which can be positioned vertically or horizontally, the entire contents of which are incorporated herein by reference. However, the operation of altering the position of casing involves releasing a latching mechanism and manually turning the pump casing until the latch engages one of the tabs in the pump housing to align and secure the outlet in the desired position.

There is a need for a simple method of selecting the position of the outlet which involved less manual handling of the pump with easier selection of the outlet position to suit different operational requirements and configurations of the fluid circulation system.

SUMMARY

Provided herein is a liquid pump for use with a fluid circulation system for a body of water which can include a strainer assembly; a centrifugal pump assembly having at least first and second outlet ports respectively oriented in vertical and horizontal directions; a motor; and, at least one cap configured and dimensioned to engage and close an outlet port.

BRIEF DESCRIPTION OF THE DRAWINGS

Various embodiments are described below with reference to the drawings wherein.

Like reference numerals indicate similar parts throughout the figures.

DETAILED DESCRIPTION OF PREFERRED EMBODIMENT(S)

The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Reference will now be made in detail to the exemplary embodiments of the present disclosure, which are illustrated in the accompanying figures.

The swimming pool pump assembly described herein includes a centrifugal pump assembly which has a casing with a double outside shell to minimize expansion and obtain the benefit of thinner walls to save in material costs and minimize the visible internal shell expansion. Plural outlet ports are included for the end user to easily select the direction of fluid outlet. A cap for the outlet ports allows the end user to select the desired outlet without manually disengaging the centrifugal pump to change its configuration. The centrifugal pump housing is streamlined to improve performance. The front side of the centrifugal pump assembly is circular to have better water movement inside the pump. A housing extension is provided to cover the motor face. The housing extension also preferably has a slot at the bottom for the passage of air to cool the motor and for drainage of water in case of a leakage. Grounding plates for water bonding may be built into the swimming pool pump assembly to conform to state and federal ordinances.

Figure 1:
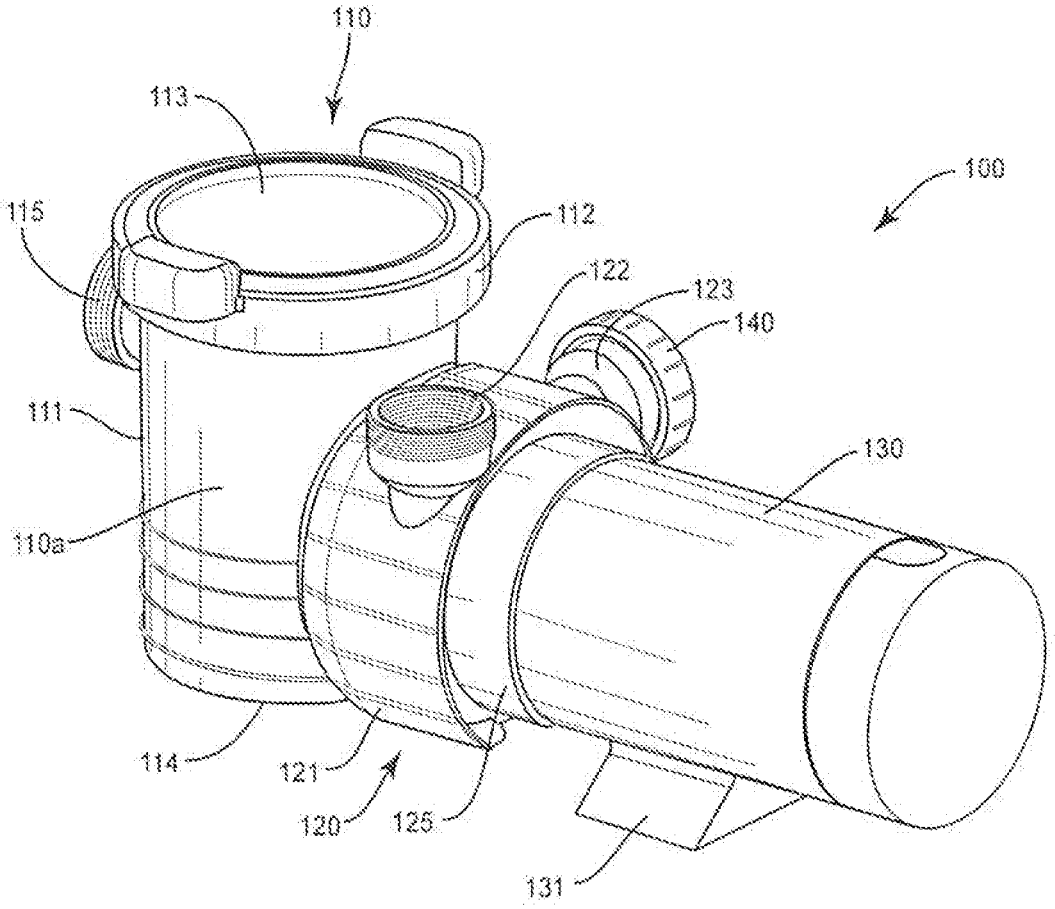
FIG. 1 is a perspective view of the swimming pool pump assembly of the present disclosure.
Figure 2:
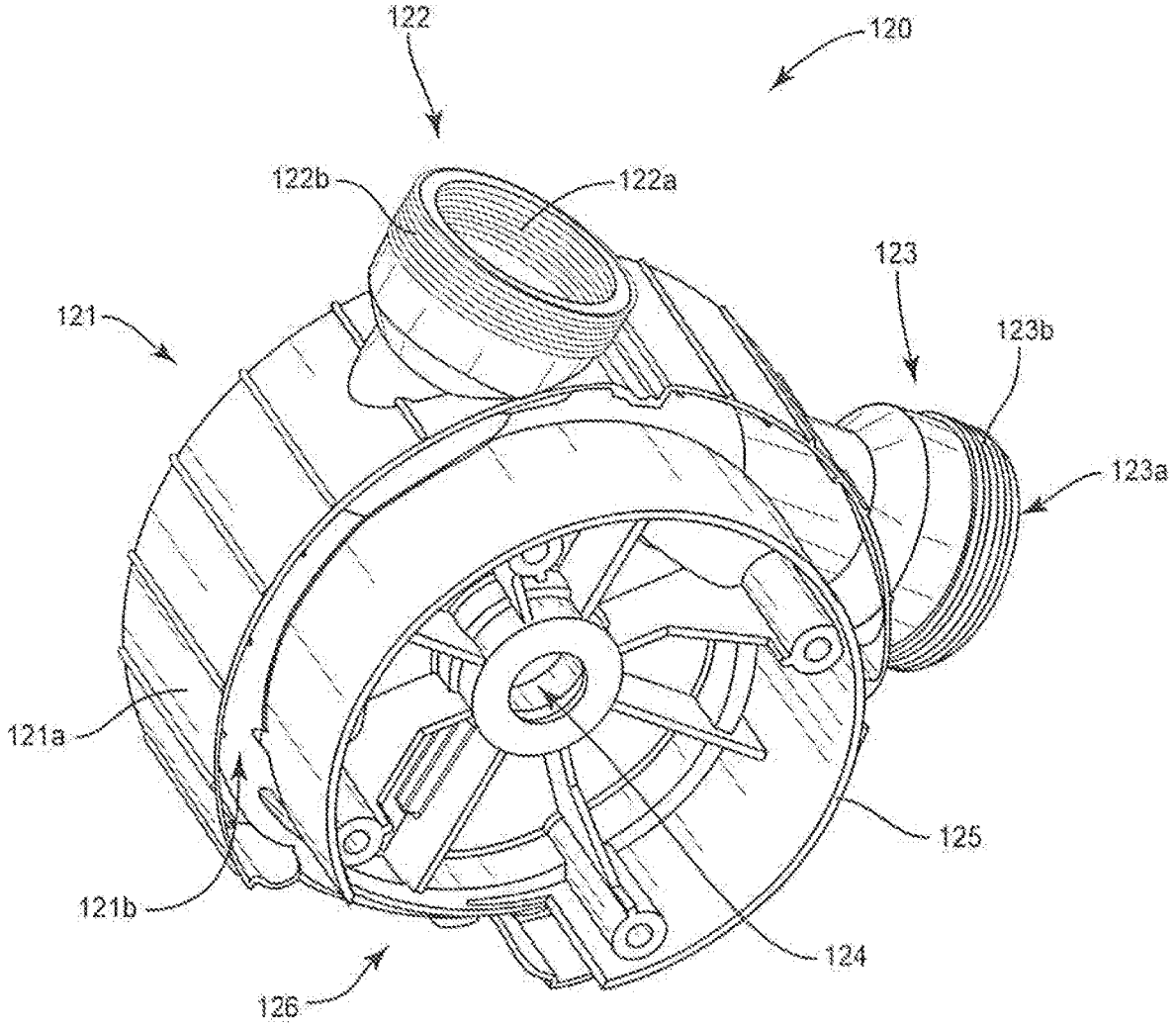
FIG. 2 is a perspective view of the inlet side of the centrifugal pump assembly.
Figure 3:
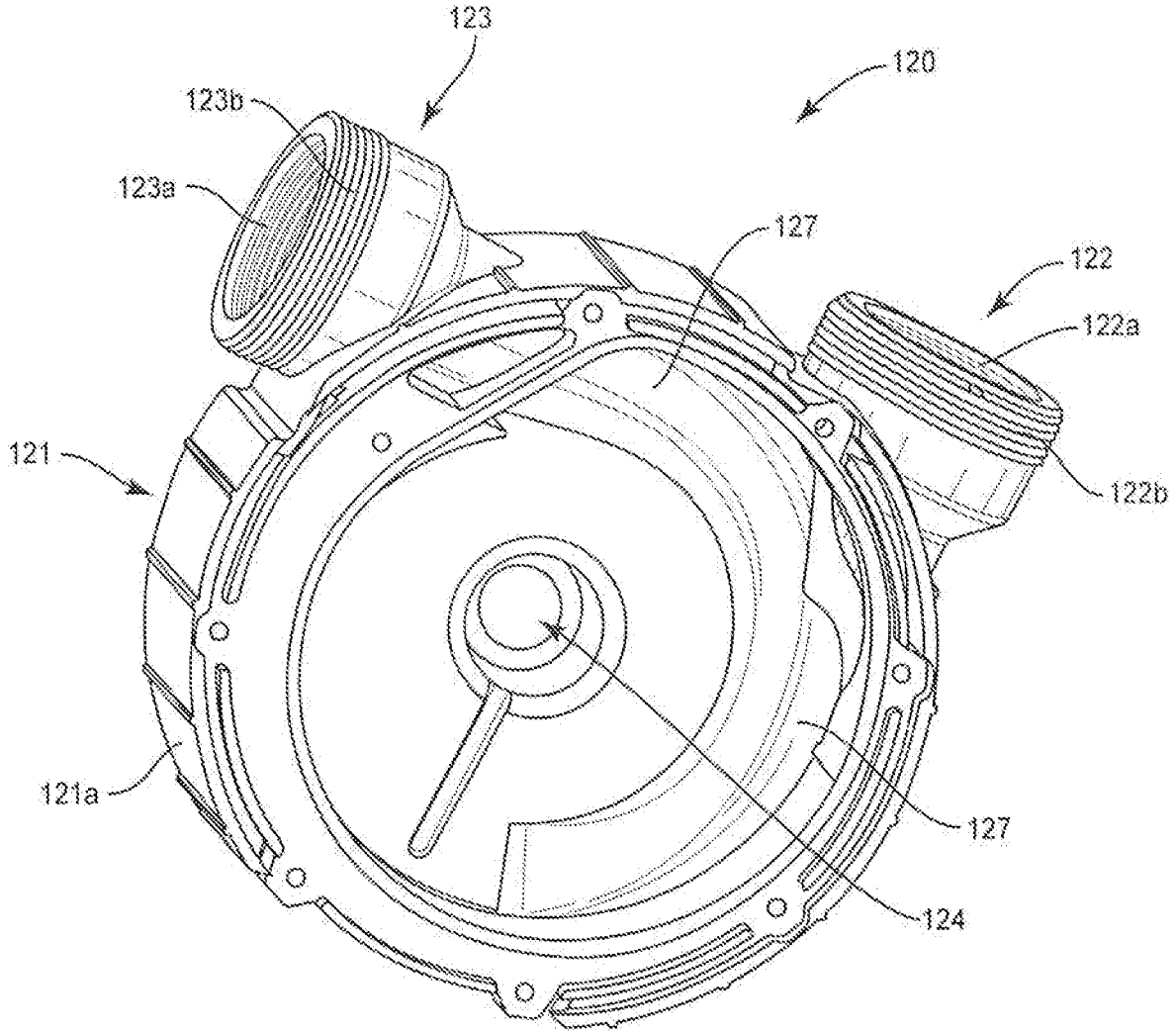
FIG. 3 is a perspective view of the outlet side of the centrifugal pump assembly.

More particularly now referring to FIGS. 1, 2 and 3, swimming pool pump assembly 100 includes a strainer assembly 110, a centrifugal pump assembly 120 and a motor 130. Strainer assembly includes a strainer housing 110*a* that has a front side 111, a rear side 112, a top 113 and a bottom 114. An inlet 115 for water is positioned on front side 111 of the strainer housing. A strainer basket (not shown) is typically enclosed in strainer housing 110*a* and is employed to filter the water passing therethrough. An outlet of the strainer assembly admits filtered water into centrifugal pump assembly 120.

Centrifugal pump assembly 120 includes a casing 121 having an outer shell 121*a* and an inner shell 121*b* (FIG. 2) concentrically disposed within outer shell 121*a* and spaced apart therefrom. Centrifugal pump assembly 120 includes at least first and second outlet ports 122/123. First outlet port 122 can include an internal thread 122*a* and an external thread 122*b* and is oriented in a vertical direction (see FIG. 1). Second outlet port 123 can include an internal thread 123*a* and an external thread 123*b* and is oriented in a horizontal direction (see FIG. 1). Additional outlet ports can be incorporated in the centrifugal pump assembly to accommodate other outlet directions. Preferably, the outlet ports are of the same size and configuration, although they may be constructed of different sizes and configurations if desired. Axial aperture 124 is adapted to receive a rotatable shaft powered by motor 130 to operate the rotor (not shown) of the centrifugal pump. Centrifugal pump assembly 130 also includes an annular housing extension 125 to cover a motor face. Housing extension 125 preferably has a slot 126 at the bottom to permit the passage of air to cool the motor. Also, if there is any leakage of water into centrifugal pump assembly 120, slot 126 facilitates its drainage.

Motor 130 rests upon pedestal 131 and is a conventional pool pump motor.

The invention further includes at least one cap 140 (FIG. 1) configured and dimensioned to fit on and close an outlet port 122 or 123. Typically, cap 140 will have an internal thread configured and dimensioned to engage the external thread of the outlet port. However, it is also possible for the cap to have an external thread adapted to engage the internal thread of the outlet port to be closed.

The outlet side of centrifugal pump assembly 120 is shown in FIG. 3. Included therein is a channel 127 formed into the outer circumference of the centrifugal pump assembly 120. Channel 127 connects with each outlet port 122/123. Channel 127 assists to direct the flow of water to and out of outlet ports 122/123.

A significant feature of the invention is the option given to the end user to select the desired outlet port direction with a minimum of handling. For example, if the end user wishes to have a vertical outlet for swimming pool pump assembly 100, cap 140 can be screwed onto horizontal second outlet port 123 to close it off and allow water to exit only through vertical first outlet port 122. Conversely, if the user wishes to have a horizontal outlet for swimming pool pump assembly 100, cap 140 can be screwed onto vertical first second outlet port 122 to close it off and allow water to exit only through horizontal second outlet port 123. The centrifugal pump casing and outlet ports are stationary and do not rotate relative to the strainer assembly or motor. Additional manipulation of swimming pool pump assembly 100 is not needed for the purpose of outlet port selection, thereby providing a fluid pump with reduced complexity, lower cost and greater adjustability and user convenience. Alternatively, both outlet ports 122, 123 can be left open as shown in FIGS. 2 and 3.

While the above description contains many specifics, these specifics should not be construed as limitations of the invention, but merely as exemplifications of preferred embodiments thereof. For example, the swimming pool pump assembly can be in connection with fluid circulation systems for swimming pools, spas, hot tubs, whirlpools, and any other bathing facilities. Those skilled in the art will envision many other embodiments within the scope and spirit of the invention as defined by the claims appended hereto.

What is claimed is:

1. A liquid pump for use with a fluid circulation system for a body of water, comprising:

a centrifugal pump assembly (120) having a casing (121);

first and second outlet ports (122, 123) continuously communicating with an interior of said casing (121) without interruption, oriented in different directions from one another along the same plane, extending tangentially outwardly from the interior of said casing (121), and configured to both be open at the same time to allow liquid to simultaneously flow out of the casing (121) through both said outlet ports (122, 123); and an axially-extending aperture (124) arranged to receive a rotatable shaft powered by a motor (130)

wherein the different directions allow for a vertical and horizontal arrangement of the first and second outlet ports, in addition to other arrangements of the first and second outlet ports with respect to one another, and the outlet ports are connected by a channel formed in the casing.

2. The liquid pump of claim 1, wherein the centrifugal pump assembly is configured to mate with a strainer assembly on an inside side of the centrifugal pump assembly and mate with the motor on an outlet side of the centrifugal pump assembly.

3. The liquid pump of claim 1 wherein the first outlet and the second outlet are respectively oriented in vertical and horizontal positions.

4. The liquid pump of claim 1 wherein the first and second outlet ports each have internal and external threads.

5. The liquid pump of claim 1 wherein the centrifugal pump assembly includes a casing having an inner shell and an outer shell.

6. The liquid pump of claim 5 wherein the inner shell and outer shell are concentric and spaced apart from each other.

7. The liquid pump of claim 6 further including a housing extension adapted to cover a face of the motor.

8. The liquid pump of claim 7 wherein the housing extension includes a slot at a bottom of the housing extension.

9. The liquid pump of claim 1 wherein said liquid pump is connected to a water circulation system for a swimming pool.

10. The liquid pump of claim 1, wherein the channel is positioned along an inner circumference.

11. The liquid pump of claim 1 wherein the first and second outlet ports (122, 123) are oriented substantially perpendicularly to one another.

12. A method for selecting the direction of fluid outflow from a centrifugal pump comprising:

providing a liquid pump including:

a strainer assembly, a centrifugal pump assembly having at least first and second outlet ports oriented in different directions, and a motor, wherein the first outlet and the second outlet ports (122, 123) continuously communicate with an interior of a casing (121) of the pump assembly (120), are oriented in different directions from one another along the same plane, extend tangentially outwardly from the interior of said casing (121), and are configured to both be open at the same time to allow liquid to simultaneously flow out of the casing (121) through both said outlet ports (122, 123); and selecting the direction of liquid outflow, with the outlet ports (122, 123) additionally oriented in different directions from an axially-extending aperture (124) to receive a rotatable shaft powered by the motor (130), the different directions allowing for a vertical and horizontal arrangement of the first and second outlet ports, in addition to other arrangement of the first and second outlet ports with respect to one another, and the outlet ports are connected by a channel formed in the casing.

13. The method of claim 12 wherein the first and second outlet ports are each threaded.

* * * * *